US005992489A

United States Patent [19]

Busse

[11] Patent Number: 5,992,489

[45] Date of Patent: Nov. 30, 1999

[54] CUP FORMING MACHINE

[75] Inventor: Charles E. Busse, Phoenix, Md.

[73] Assignee: Sweetheart Cup Company Inc., Owings Mills, Md.

[21] Appl. No.: 08/919,441

[22] Filed: Aug. 28, 1997

[51] Int. Cl.[6] ..... B31F 03/00; B65C 09/00; B31B 01/90; B65B 01/02

[52] U.S. Cl. ..... 156/443; 156/446; 156/499; 156/506; 156/569; 493/102; 493/106; 493/158; 493/159; 53/563

[58] Field of Search ..... 156/69, 215, 443, 156/446, 499, 566, 567; 493/102, 106, 107, 158, 159, 108, 109; 53/563

[56] References Cited

U.S. PATENT DOCUMENTS

| | | | |
|---|---|---|---|
| 3,439,590 | 4/1969 | Rosenberg et al. | 99/55.1 |
| 3,602,690 | 8/1971 | Rosenberg et al. | 219/373 |
| 3,990,353 | 11/1976 | Richards et al. | 93/1.3 |
| 4,100,842 | 7/1978 | Richards et al. | 493/107 |
| 4,349,400 | 9/1982 | Gilden | 156/217 |
| 4,402,202 | 9/1983 | Gombas | 72/94 |
| 4,409,045 | 10/1983 | Busse | 156/69 |
| 5,337,622 | 8/1994 | Konzal | 74/813 R |

*Primary Examiner*—Richard Crispino
*Assistant Examiner*—J. A. Lorengo
*Attorney, Agent, or Firm*—Nixon & Vanderhye P.C.

[57] ABSTRACT

A container forming apparatus having multiple working stations for producing a two piece, open top, closed bottom container including means for feeding flat blanks to a first rotating turret; the first rotary turret fixed for rotation about a horizontal axis, and having a plurality of radially projecting mandrels thereon. Container bottoms are fed to the first rotating turret upstream of the flat blanks relative to a direction of rotation of the turret, and each of the flat blanks is folded in succession about respective mandrels. The bottoms are secured to each of the blanks by a vacuum at a first station to thereby form individual container assemblies. The drive indexes the turret so that each mandrel is rotated to successive workstations arranged circumferentially about the first turret. The successive workstations include at least one container bottom heating station, a bottom curl station and at least one bottom expander station. A second turret located below the first turret and rotated about a vertical axis includes apertures for receiving workpieces from the first turret and also includes plural container rim curling steps.

13 Claims, 5 Drawing Sheets

CUP FORMING MACHINE

This invention relates to container forming machines generally, and specifically to machines for forming open-top paper cups which include a longitudinally seamed body and a discrete bottom.

BACKGROUND

It is, of course, well known to form containers made of paper products using machines which form a generally cylindrical body and associated bottom using one or more turrets and related forming tools. One conventional apparatus utilizes a vertically oriented turret (i.e., a turret rotating about a horizontal axis) to wrap and seam a container blank, followed by two transfers and then additional stations where bottom finishing, forming and top curling steps are performed. This system requires at least four transfers, thus slowing the process and creating ample opportunities for misalignment and other gliches leading to excessive downtime and hence, decreased productivity.

Various methods and apparatus for forming paper cups or like containers may be found in U.S. Pat. Nos. 4,409,045; 3,990,353; 3,620,690; and 3,439,590.

SUMMARY OF THE INVENTION

The present invention seeks to improve the known paper container forming methods and apparatus by minimizing and simplifying the transfers of container blanks during the forming stages, thereby improving both reliability and productivity.

In the exemplary embodiment of the invention, flat container blanks are fed horizontally to a first forming turret, arranged to rotate in a vertical plane about a horizontal axis. The turret includes a plurality of mandrels projecting radially outwardly from the hub of the turret, and the mandrels are successively indexed to working stations arranged about the turret. At the same time, a continuous strip of bottom blank material is fed to the turret upstream of the flat container blanks, where container bottoms are cut successively from the strip and held to the bottom of respective mandrels by conventional means, such as, for example, vacuum. The container blanks approach the turret in a radial direction, while subjected to plural heating steps which activate the adhesive along respective axial edges of the blanks. The heated blanks are successively received on respective mandrels and a conventional folding apparatus acts in concert with the turret at a first station to fold the blanks about their respective mandrel and adhesively seal the overlapped edges to form axial seams. The lower edge of each container blank encloses the bottom and projects axially beyond the latter.

The turret indexes the now generally cylindrical open top container blanks (typically, the containers are tapered outwardly from bottom to top) to a plurality of bottom heating stations (three in the exemplary embodiment). The bottom heating stations preheat the adhesive coating on the bottom and side wall for the bottom sealing operation. After preheating, the end of the side wall of each container is rolled into close proximity of the bottom skirt in the curl station. The final sealing operation is performed at the expander stations where pressure is applied to the preheated adhesive coating.

Thereafter, each container is discharged under the influence air under pressure assisted by gravity, onto a second turret rotating in a horizontal plane about a vertical axis.

The second turret includes a flat plate provided with apertures about the periphery thereof, each aperture adapted and arranged to receive a container and bottom assembly from the first turret. The containers are successively indexed through sequentially arranged pre curl, finish curl and size curl stations which act on the upper edge of the side wall blank, completing the container formation steps, readying the containers for filling and capping.

The first and second turrets are driven from a main drive and associated timing belts and gears as described in greater detail below.

The container forming turret configurations as described herein has advantages relating to high speed cup processing performance; drive system durability; reliable product transfer; and ergonomic machine configuration.

Accordingly, in its broader aspects, the present invention relates to a container forming apparatus having multiple working stations for producing an open top, closed bottom container comprising means for feeding flat blanks to a first rotating turret; the first rotary turret fixed for rotation about a horizontal axis, and having a plurality of radially projecting mandrels thereon; means for feeding container bottoms to the first rotating turret upstream of the flat blanks relative to a direction of rotation of the turret; means for folding each of the flat blanks in succession about respective mandrels and for securing a respective one of the bottoms to each of the blanks at a first station to thereby form individual container assemblies; drive means for indexing the turret so that each mandrel is rotated to successive workstations arranged circumferentially about the first turret, the successive workstations including at least one container bottom heating station, a bottom curl station and at least one bottom expander station.

In another aspect, the invention relates to a container forming apparatus having multiple workstations for producing a two piece, open top, closed bottom container comprising a first turret rotatable about a horizontal axis, the turret having a plurality of radially outwardly projecting mandrels, each adapted to support a workpiece; a plurality of workstations arranged about the first turret; a second turret rotatable about a vertical axis, the second turret having a plurality of workpiece receiving apertures formed about a periphery thereof; a plurality of workstations arranged about the second turret; and a main drive having an output shaft connected to a first gear box driving a first shaft operatively connected to the first turret; a second gear box driving a second shaft operatively connected to said second turret and where the first and second plurality of workstations are driven indirectly the first and second shafts.

Other objects and advantages will become apparent from the detailed description which follows.

DETAILED DESCRIPTION OF THE DRAWINGS

Figure 1:
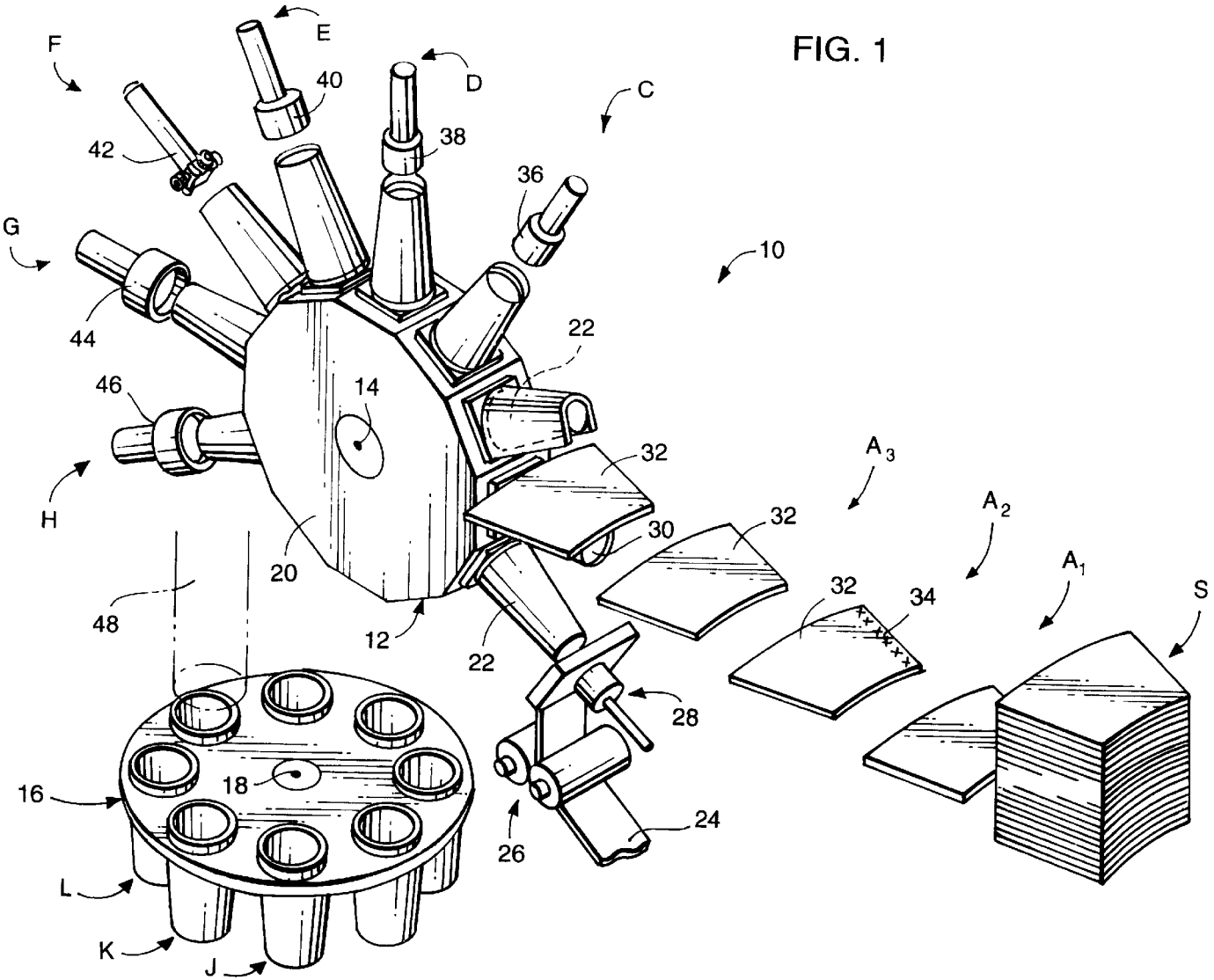
FIG. 1 is a partial perspective view of a container forming apparatus in accordance with the invention.
Figure 2:
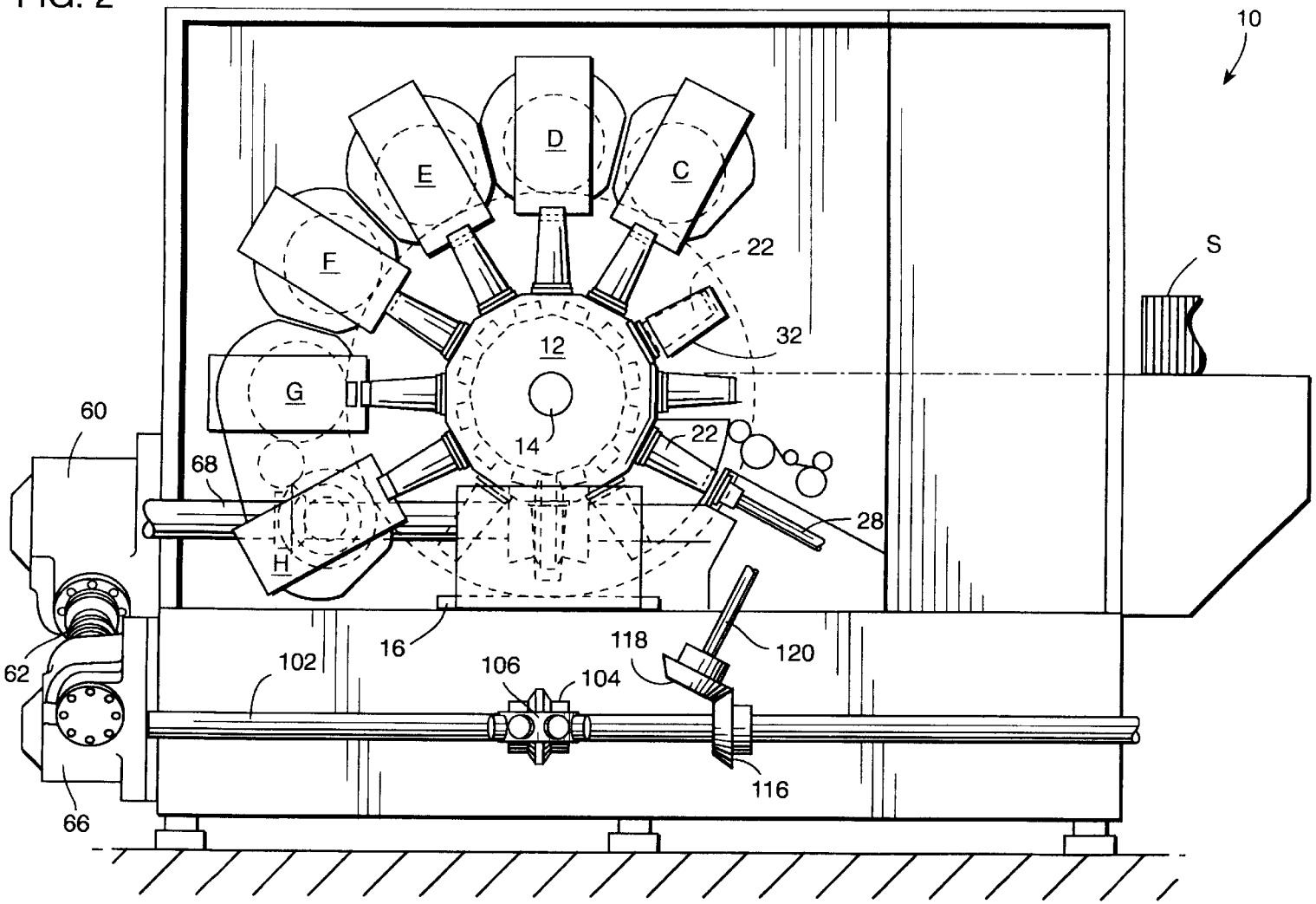
FIG. 2 is a partial side elevation of the apparatus depicted generally in FIG. 1.
Figure 3:
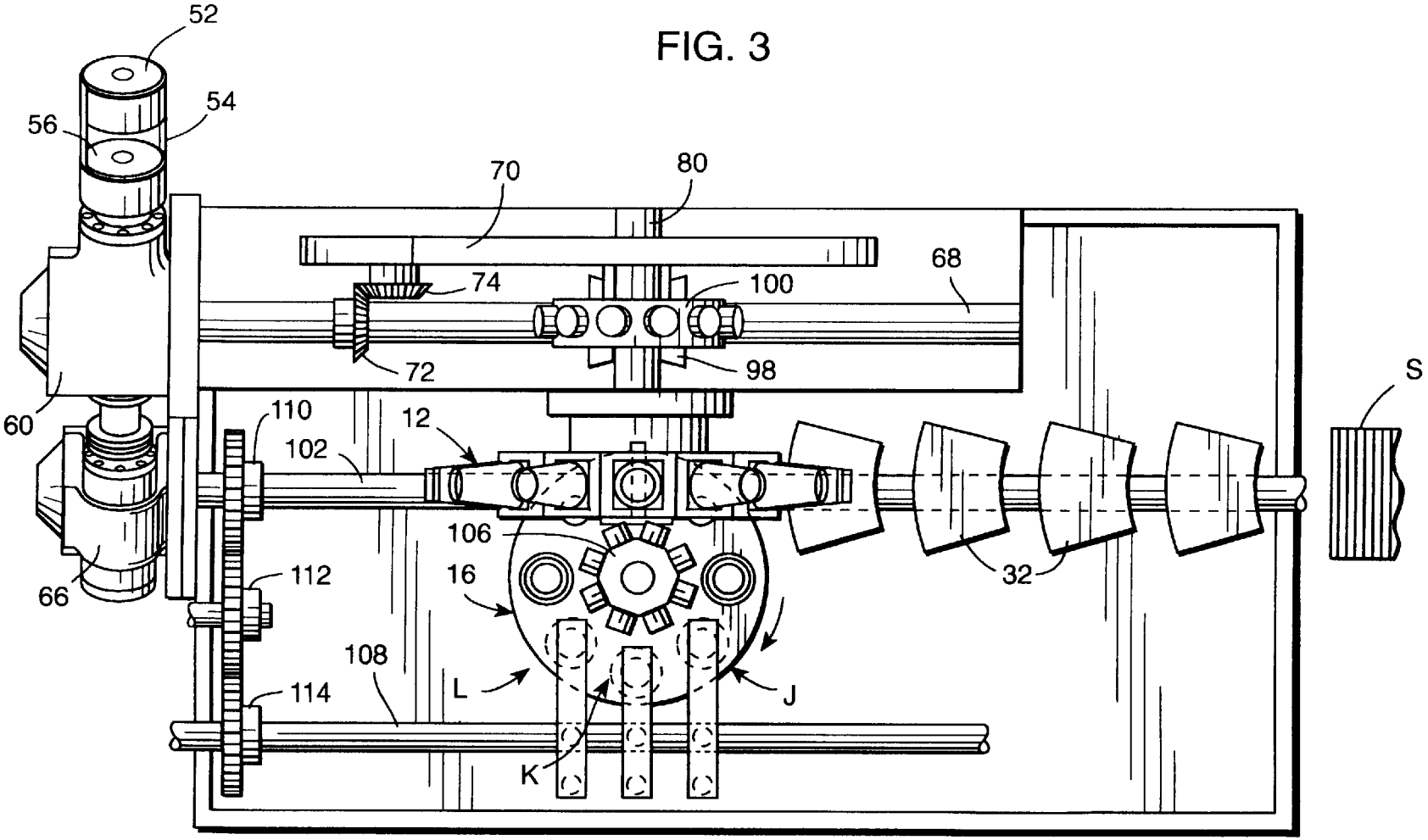
FIG. 3 is a plan view of the apparatus shown in FIG. 2.
Figure 4:
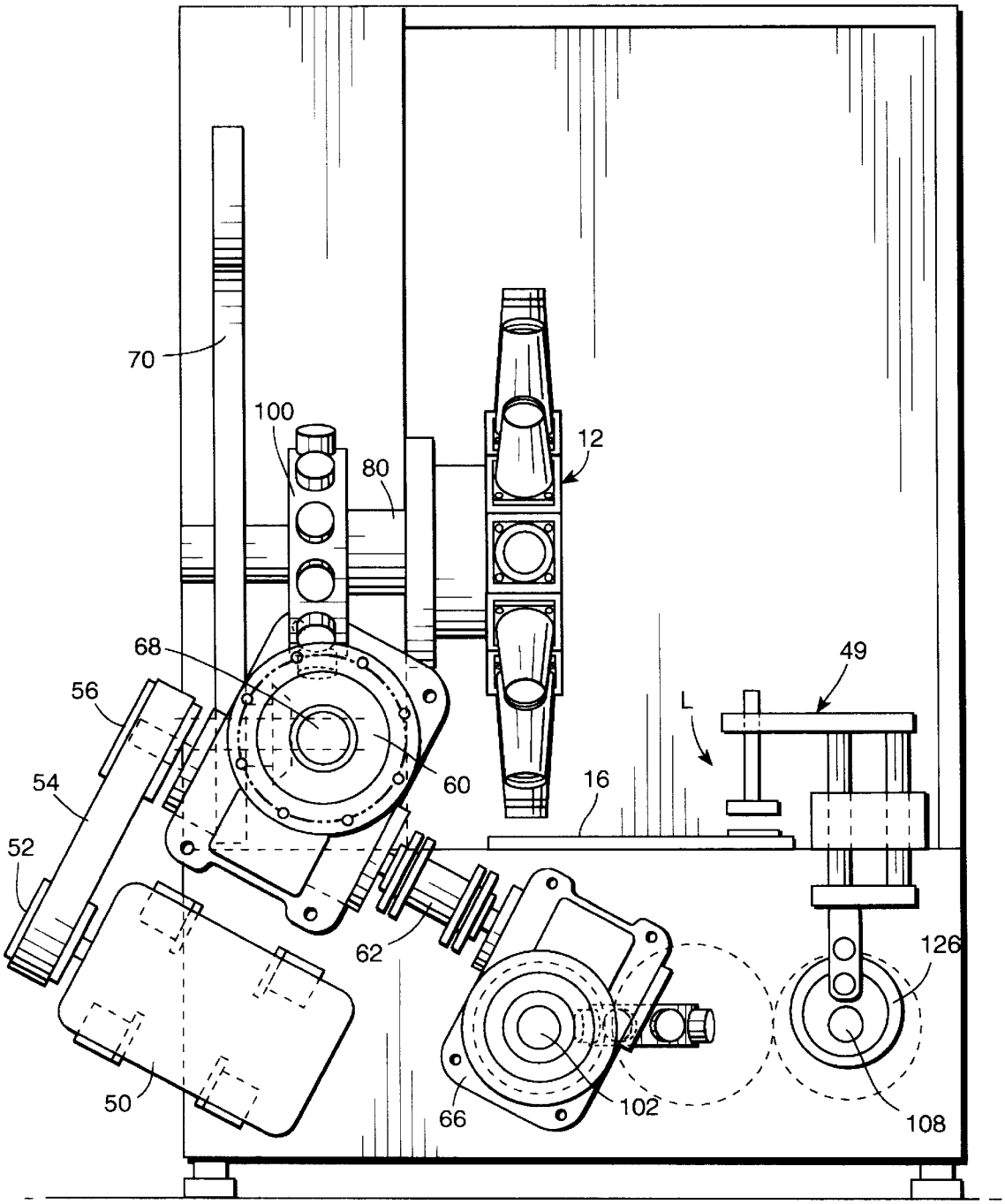
FIG. 4 is an end elevation of the apparatus shown in FIG. 2.

With particular reference to FIG. 1, but also to FIGS. 2–4, the manufacture of a two-piece, frustoconical cup is commenced by means of a forming apparatus 10 comprising a first forming turret 12 fixed for rotation about a horizontal axis 14, in combination with a second forming turret 16 fixed for rotation about a vertical shaft or axis 18. The turret 12 comprises a conventional hub member 20 having a plurality of frustoconical mandrels 22 secured thereto and extending radially outwardly therefrom. The turret 12 is rotated intermittently by means described further below, so that the mandrels are successively positioned adjacent reciprocable tool stations at which various steps in the process of forming the cups are carried out. As viewed in FIG. 1, the first vertically oriented turret 12 rotates in a counterclockwise direction. The sequence comprises, generally, placing on each mandrel 22, at a first station A, a blank cut and formed from a continuous strip 24 which is fed between a pair of rolls 26 and from which the bottom blank is cut and formed by a conventional tool 28. The cup bottom blank 30 is held to the outer end of the mandrel by conventional vacuum means, or inserted into a pocket formed in the end of the mandrel, and a respective side wall blank 32 is fed from a stack S of such blanks (by conveyor or other suitable means) to a second workstation B where it is folded about the circumference of one of the mandrels 22, overlapping the bottom blank 30 also in a conventional manner.

The side wall blanks have a heat sealable adhesive coating covering their entire surfaces. The pattern shown at 34 represents the area that is preheated for sealing. As the side wall blanks 32 are fed to the workstation B, an edge of the blank 32 is heated along area 34 at three successive locations $A_1$, $A_2$ and $A_3$ prior to reaching station B. These applications of heat are targeted to the adhesive area 34 so that the side wall blank, after folding or wrapping about the mandrel, may be subjected to a conventional seam clamp to provide the necessary pressure for proper bonding of the lapped side wall seam.

At subsequent stations C, D and E, the cup bottoms are subjected to further successive applications of heat, again in a conventional manner, utilizing heaters 36, 38 and 40. At station F, the bottom end of the side wall blank is curled into close proximity to the bottom cup blank by a conventional curling mechanism 42 and, at stations G and H, first and second bottom expander operations are carried out by conventional expander mechanisms 44, 46 to seal the bottom blanks to the side wall blanks.

Figure 5:
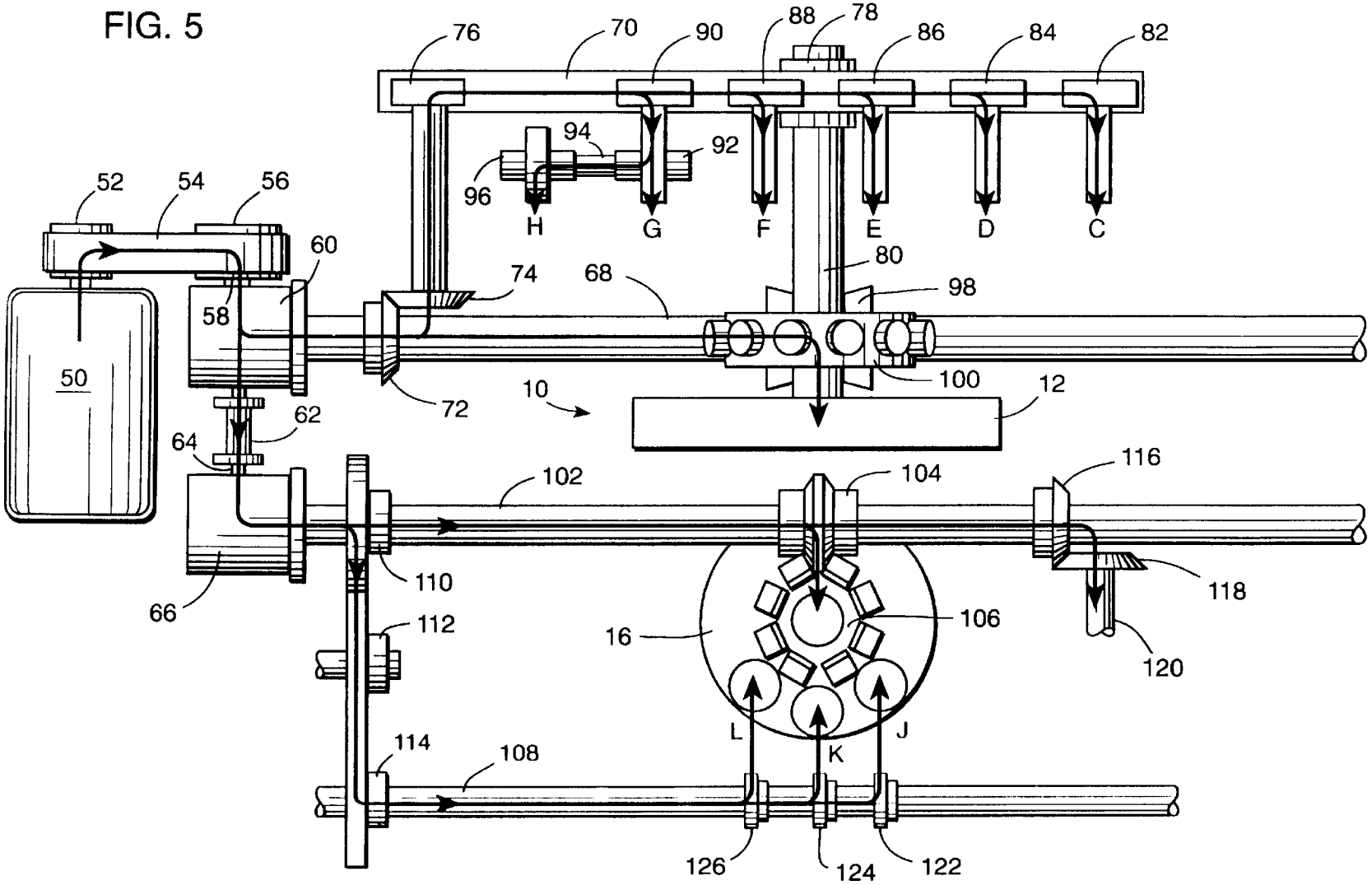
FIG. 5 is a simplified plan view illust schematically the drive components of the apparatus in accordance with the invention.

As the turret 12 continues to index in a counterclockwise direction, the two-piece cup blank is transferred by air and assisted by gravity into an appropriately sized aperture in the second horizontally oriented turret 16. This turret 16, rotating in a clockwise direction, further indexes the cup blanks to a plurality of curling stations indicated at J, K and L, respectively. At these stations, conventional pre curl, finish curl and size curl operations are carried out with respect to the upper edge of the cup blank. Conventional tooling (vertically reciprocable above the turret 16) is used, and one such mechanism is shown generally at 49 in FIG. 4. Thereafter, the finished cup is discharged upwardly through a transparent tube indicated at 48. As will be appreciated, the above described arrangement provides a simple two turret arrangement for completely forming a two-piece paperboard container with minimal transfers among turret or other feeding mechanisms. The drive arrangement for the various components of the apparatus will now be described in detail with specific reference to FIG. 5 but various of the drive components are also shown in FIGS. 2–4.

The drive from the main motor 50 is transmitted from timing pulley 52 through timing belt 54 to timing pulley 56 which is connected to, and turns the input shaft 58 of gear box 60. The opposite end of the input shaft of gear box 60 has a flexible coupling 62 which connects to, and turns the input shaft 64 of gear box 66. The gear boxes are double enveloping worm gear reducers and are close coupled at their input shaft and mounted around their output shafts to eliminate backlash.

The output of gear box 60 is cam shaft 68 which drives the bull gear 70 through bevel gear 72, bevel gear 74, and spur gear 76. The bull gear is supported by bull gear bearing 78 on the forming turret index shaft (FTIS) 80 and is free to turn independent of the FTIS. The bull gear 70 drives spur gears 82, 84, 86, 88 and 90, which in turn drive the reciprocable bottom heaters at work stations C, D, and E, along with the reciprocable bottom curler at F, and bottom expander at G, respectively. Spur gear 92 on bottom expander G drives spur gear 94, which in turn drives spur gear 96 and the bottom expander H.

Cam shaft 68 also turns forming turret index cam 98, which is attached to the cam shaft, and indexes forming turret follower plate 100, forming turret index shaft 80, and the first forming turret 12, which are all connected together. The drive to the indexing forming turret 12 and the work stations, which are positioned radially around the forming turret, is completed with a minimum of gears and backlash, insuring smooth high speed timing and performance.

The output of gear box 66 is cam shaft 102, which turns curling turret index cam 104, which is attached to cam shaft 102, and indexes curling turret follower plate 106, and the curling turret 16, which are connected together. Cam shaft 102 also drives cam shaft 108 through spur gear 110, spur gear 112, and spur gear 114. Cam shaft 102 also drives bottom blank and former 28 through bevel gear 116, bevel gear 118 and shaft 120.

Cam shaft 108 turns curling cam 122, curling cam 124, and curling cam 126, which are attached to cam shaft 108, and actuate curling tooling to move toward and away from the upper rim of the containers seated in turret 16 at stations J, K and L, respectively.

It will be appreciated that variations of the above described arrangement may be appropriate for specific applications. For example, the number of heating steps performed on the blank bottoms at stations C, D and E may be altered. Similarly, the number of bottom expanding tools at stations G and H, and the number of curling operations at stations J, K and L may also be varied. What is particularly important in any case is the simplified arrangement of turrets and drive components which enable high quality paper products to be formed and assembled with greater efficiency at reduced cost.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A container forming apparatus having multiple working stations for producing a two piece, open top, closed bottom container comprising:

means for feeding flat blanks to a first rotating turret;

said first rotary turret fixed for rotation about a horizontal axis, and having a plurality of radially projecting mandrels thereon;

means for folding each of said flat blanks in succession about respective mandrels and for securing a respective one of said bottoms to each of said blanks at a first station to thereby form individual container assemblies;

a second rotating turret fixed for rotation about a vertical axis, said second rotating turret having a plurality of apertures therein, sized to receive said individual container assemblies, wherein said container assemblies are transferred by air and assisted by gravity into respective ones of said apertures;

drive means for indexing said first and second rotary turrets to successive workstations arranged circumferentially about said first and second rotary turrets, said workstations associated with said first rotary turret including at least one container bottom heating station, a bottom curl station and at least one bottom expander station, and wherein said drive means further includes a single main motor for driving directly or indirectly tools at all of said workstations associated with said first and second rotary turrets.

2. The apparatus of claim 1 and further comprising plural curling tools at successive stations adjacent said second rotating turret for curling upper edges of said blanks, said drive means indexing said container assemblies successively to said plural curling tools to thereby complete each of said open top, closed bottom containers.

3. The apparatus of claim 1 and including means for heating said flat blanks before said flat blanks reach said first rotating turret.

4. The apparatus of claim 1 wherein said flat blanks are constructed of paper based material, and wherein said bottoms are secured to said blanks by at least one bottom expander.

5. The apparatus according to claim 1 wherein said successive workstations include three bottom heating stations.

6. The apparatus according to claim 1 wherein said successive workstations include a pair of bottom expander stations.

7. The apparatus according to claim 4 wherein said means for heating said flat blanks include three discrete heating stations arranged to apply heat along at least one substantially axially oriented edge of said flat blanks.

8. The apparatus of claim 3 wherein said plural curling tools include pre curl, finish curl and size curl tools arranged at three respective stations located peripherally about said second rotating mandrel.

9. A container forming apparatus having multiple workstations for producing a two piece, open top, closed bottom container comprising:

a first turret rotatable about a horizontal axis, said turret having a plurality of radially outwardly projecting mandrels, each adapted to support a workpiece;

a plurality of workstations arranged about said first turret;

a second turret rotatable about a vertical axis, said second turret having a plurality of workpiece receiving apertures formed about a periphery thereof arranged to receive workpieces from said first turret;

a plurality of workstations arranged about said second turret; and a main drive having an output shaft connected to a first gear box driving a first shaft operatively connected to said first turret; a second gear box driving a second shaft operatively connected to said second turret and wherein said first and second plurality of workstations are driven indirectly by said first and second shafts.

10. The apparatus of claim 9 wherein said first shaft drives a bull gear operatively attached to said plurality of workstations arranged about said first turret.

11. The apparatus of claim 9 wherein said second shaft drives a cam shaft which drives said plurality of workstations arranged about said second turret.

12. The apparatus of claim 10 wherein said plurality of workstations arranged about said first turret includes at least two container bottom heating stations.

13. The apparatus of claim 11 wherein said plurality of workstations arranged about said second turret includes at least two curling stations with reciprocable tooling for curling an upper rim of the container.

* * * * *